US005573047A

United States Patent [19]

Akin

[11] Patent Number: 5,573,047

[45] Date of Patent: Nov. 12, 1996

[54] SEAL-PIERCING INSERT FOR A BOTTLED WATER DISPENSER

[76] Inventor: Richard M. Akin, 1567 Andover Dr., Dunedin, Fla. 34698

[21] Appl. No.: 497,852

[22] Filed: Jul. 3, 1995

[51] Int. Cl.[6] ..... B65B 1/04

[52] U.S. Cl. ..... 141/330; 222/81

[58] Field of Search ..... 141/329, 330, 141/19; 222/81, 90, 88, 89

[56] References Cited

U.S. PATENT DOCUMENTS

| | | | |
|---|---|---|---|
| D. 277,255 | 1/1985 | Deruntz | D7/387 |
| 1,028,542 | 6/1912 | Christian | 141/329 |
| 1,316,122 | 9/1919 | Vall | 222/88 |
| 2,002,611 | 5/1935 | Nall | 141/329 |
| 2,007,449 | 7/1935 | Kernodle et al. | 222/90 |
| 2,017,818 | 10/1935 | Reynolds | 141/329 |
| 2,023,397 | 12/1935 | Blomgren | 222/90 |
| 2,806,635 | 9/1957 | Kader et al. | 222/88 |
| 3,115,908 | 12/1963 | Carlson et al. | 141/330 |
| 4,846,236 | 7/1989 | Deruntz | 141/329 |

*Primary Examiner*—David J. Walczak
*Assistant Examiner*—Steven O. Douglas
*Attorney, Agent, or Firm*—David Kiewit

[57] ABSTRACT

A seal-piercing device has a pyramidal array of knife-edged blades defining at least one face open to the flow of water. The open face is partly obscured by spreader elements preventing a flap of the cut seal material from closing off the flow of water through that face. Other faces of the pyramid are solid and have one or more holes adjacent their bases. The solid faces preferably have flap-restraining spreaders preventing one of the cut flaps from coming into an obstructing contact with the solid face. When water is drawn from the dispensing vessel of a dispenser equipped with the seal-piercer of the invention, the air entering the bottle may flow through the holes adjacent the bases of the closed faces and upward along each face into the bottle.

7 Claims, 3 Drawing Sheets

SEAL-PIERCING INSERT FOR A BOTTLED WATER DISPENSER

BACKGROUND OF THE INVENTION

1. Field of the Invention

The present invention relates to dispensers for bottled water and particularly concerns seal-piercing devices situated in or on the dispenser for piercing a pliable neck seal on a bottle.

2. Description of Related Art

Bottled drinking water dispensers in which a filled water bottle is inverted upon a water-filled dispenser vessel have been in use for many years. In these gravity-operated dispensers, water flows from the inverted bottle into the dispenser vessel until the water level in the dispenser vessel rises to a point slightly above the neck of the bottle or of the inlet port of a coupling device interposed between the bottle and the vessel. Once the water level has reached this level, air can no longer flow into the bottle to displace water, and the water level in the bottle stays constant until water is drawn from the dispenser vessel via a conventional tap, faucet, or other means. The act of drawing off water from the vessel lowers the water level and allows air to enter the bottle so that additional water can flow out of it into the vessel.

Inserting a filled bottle into a receiving port of a dispenser is usually done by opening the bottle, quickly inverting it and inserting it into the port before too much water spills out. This is a sloppy and sometimes unhygienic procedure that can wash dirt from the neck of the bottle or from the top of the dispenser into the dispensing vessel. In the interest of making the refilling operation easier and more hygienic, prior inventors have proposed a variety of devices positionable within a dispenser receiving port and acting to open a sealed water bottle inserted thereinto. Similar devices for opening sealed liquid-containing receptacles and dispensing the liquid therefrom have been proposed for other applications, such as dispensing motor oil from a can into an engine.

In U.S. Pat. No. 4,846,236 Deruntz teaches a seal-piercing dispenser insert comprising a cruciform penetrating and spreading element having two knife-edged blades lying in a first plane and two dull spreader blades lying in a second plane perpendicular to the first plane. The disclosure of U.S. Pat. No. 4,846,236 is herein incorporated by reference. When an industry-standard water bottle (which has a flexible polymeric seal closing the mouth of the bottle independent of the bottle's orientation) is inverted and inserted into a receiving port of a water dispenser equipped with Deruntz's insert, the two knife edges slice open the seal and the two spreader edges hold the slit open against elastic restoring forces from the substantially deformed plastic cap as shown in FIG. 3 of U.S. Pat. No. 4,846,236. When a conventional light-weight plastic bottle opened with Deruntz's insert is nearly drained and the weight of water holding the bottle on the insert is reduced, the elastic restoring forces acting to close the slit can cause the bottle to rise upwards off the insert into a relatively unstable position in which an accidental blow can knock the bottle off the dispenser and spill its remaining contents.

In an earlier US design patent (U.S. Pat. No. Des. 277,255), Deruntz disclosed a cap-piercing water dispenser insert comprising a bent-pyramidal array of blades extending upward from a base of the insert. Each of the plurality of blades has a knife edge cutting into the bottle cap. As described by Deruntz in his later U.S. Pat. No. 4,846,236, the plastic flaps formed by the cutting operation of the U.S. Pat. No. Des. 277,255 device are forced into the flow path of water being discharged from the bottle by forces arising both from the flowing water and from the elastic properties of the flap.

Another bottle-unsealing means comprising a valved assembly inserted into the water-receiving port of a water dispenser is sold by Ebtech Inc. as the Ebco Waterguard®. This device comprises a blunt-nosed seal-penetrating portion of the valved assembly cooperating with a special bottle seal having a centrally disposed push-on cap. When a bottle having the appropriate seal is inverted upon the cooperating valved assembly, the seal penetrating portion pushes the small central cap off its mounting and introduces a flow inlet into the bottle. On removal of the water bottle, the small cap (which is retained on the tip of the blunt-nosed penetrator) is reseated on the stationary portion of the lid to re-seal the bottle. The complex, multi-element Ebco apparatus comprises a plurality of small passages that are difficult to clean.

Kader et al., in U.S. Pat. No. 2,806,635, teach apparatus for piercing the seal of a liquid receptacle. Their pyramid-shaped piercer comprises a plurality of knife edges extending outward at an acute angle from a longitudinal axis, all the faces of the pyramid so formed being open to fluid flow.

Reynolds, in U.S. Pat. No. 2,107,818, discloses piercing apparatus having a spreader, or deflector bar, extending outward from a surface of a knife-edged piercing member, the deflector bar preventing a cut flap from moving into and impeding flow through a hole cut by the knife edge.

Nall, in U.S. Pat. No. 2,002,611, discloses piercing apparatus for opening a liquid receptacle. Nall's apparatus comprises a plurality of knife-edged members disposed in a pyramidal array with an interleaved pyramidal array of spreader edges serving to spread and hold open the punctured and broken wall portions of a seal.

Christian, in U.S. Pat. No. 1,028,542, teaches a receptacle-piercing device providing separate flow paths for the liquid delivered from the receptacle and for the air flowing into the receptacle to displace the liquid.

SUMMARY OF THE INVENTION

The invention provides a seal-piercing device insertable into the water inlet port of a gravity-operated water dispenser, the seal-piercer having a plurality of knife-edged blades extending outward at an acute angle from a longitudinal axis toward a base, forming a generally pyramidal configuration. Some of the faces of the pyramid so defined are generally open to the flow of water, although these open faces may be partly obscured by spreader elements preventing a flap of the cut seal material from obstructing the flow. Others of the faces of the pyramid are solid and have one or more holes adjacent their bases. The solid faces preferably have flap-restraining spreaders preventing one of the cut flaps from coming into an obstructing contact with the solid face. When water is drawn from the dispensing vessel of a dispenser equipped with the seal-piercer of the invention, the air entering the bottle may flow through the holes adjacent the bases of the closed faces and upward along each face into the bottle.

It is an object of the invention to provide a cap-piercing device for use in a gravity-operated water dispenser, the cap piercer ensuring efficient water delivery by providing relatively unobstructed flow paths for both the water being delivered and the air displacing the water from the bottle.

It is an additional object of the invention to provide means for cutting a star-shaped array of three or more slits in a pliable top of a liquid receptacle and to hold the flaps formed in the cutting operation away from the axis of the cutting device.

It is a further object of the invention to provide a receptacle-opening apparatus comprising a first plurality of cutting edges slanting outward from a common axis and an interleaved plurality of spreaders wherein some of the spreaders have an undercut portion holding the apparatus to a cut seal.

DESCRIPTION OF THE PREFERRED EMBODIMENT

Figure 1:
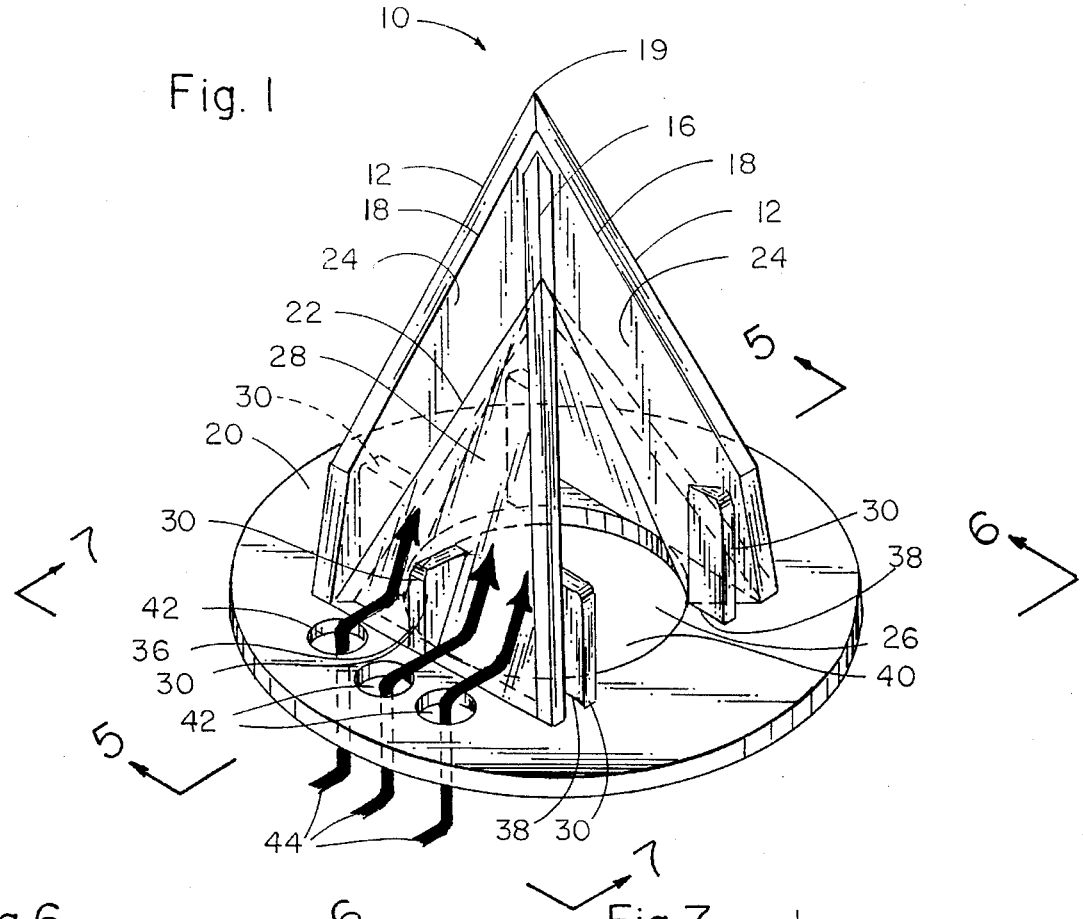
FIG. 1 of the drawing is a perspective view of a preferred embodiment of the invention.
Figure 6:
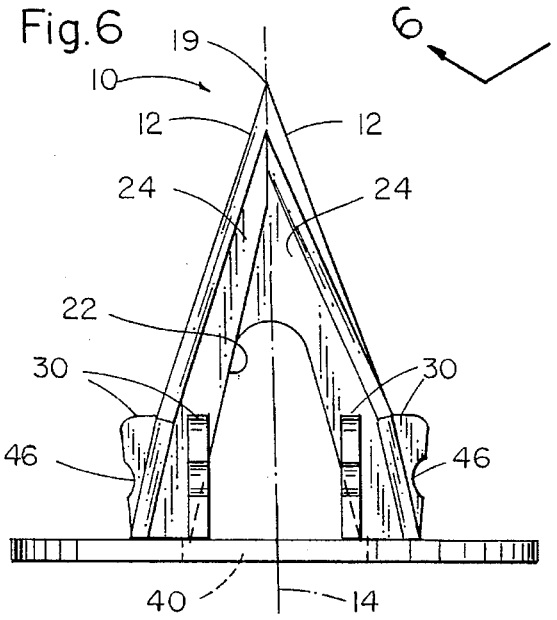
FIG. 6 of the drawing is an elevational view of the apparatus of FIG. 1 taken along the lines 6—6 of FIG. 1.

A piercer 10 of the invention comprises a generally pyramidal array of upstanding planar blades 24 slanting outward of a longitudinal axis 14 and downwards toward a base 20. In one embodiment, shown in FIG. 1, the apparatus has four knife-like cutting edges 12 formed on the upper edges of the blades 24, a first pair 16 intersecting the axis 14 at a different point than a second pair 18. Other numbers of cutting edges 12 may be used (e.g., the three-edged apparatus 10 shown in FIGS. 4 and 5). All the cutting edges 12 may share a common apex 19, or the piercer may be configured with one pair of blades 18 meeting at a first apex 19, while the cutting edges 12 of another pair of blades 16 may intersect the axis 14 at a different apex. Moreover, the cutting edges 12 may extend all the way to a base portion 20, or they may extend only along a portion of a blade 24 that forms part of a bent pyramidal configuration in which the portions of the blades 24 adjacent the base 20 define a relatively sharply pointed pyramidal shape, while those portions of the blades 24 nearer the apex or apices 19 define a pyramidal shape having a less acute apical angle (e.g., as seen in FIG. 1). In either case, a top planar view of the blades 24 shows cutting edges 12 extending radially outward from the axis 14 in a star or "hub and spoke" topology.

Figure 4:
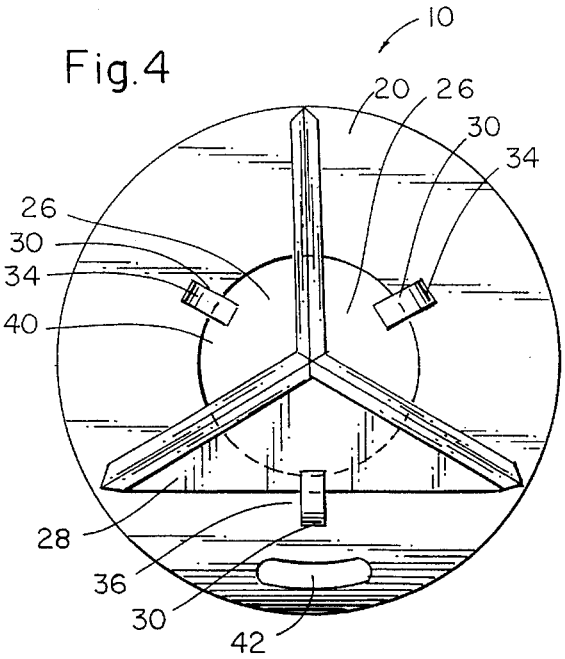
FIG. 4 of the drawing is a top plan view of a three-bladed piercer of the invention.
Figure 2:
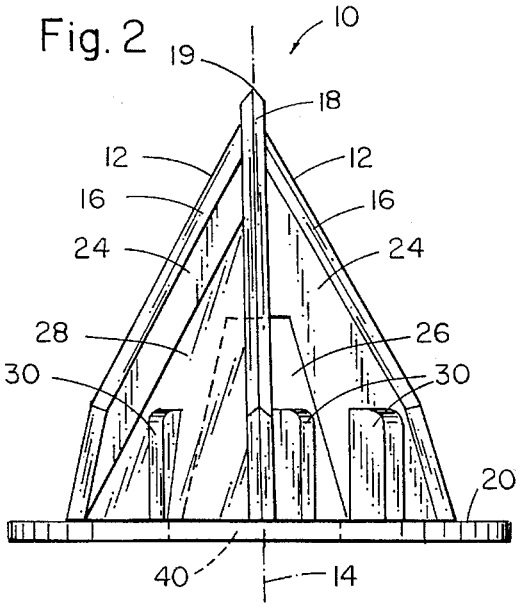
FIG. 2 of the drawing is an orthographic elevational view of the apparatus of FIG. 1.
Figure 5:
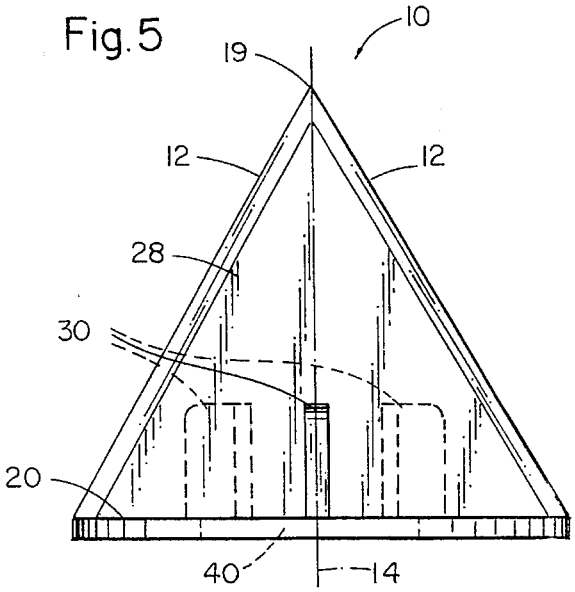
FIG. 5 of the drawing is an orthographic elevational view of the apparatus of FIG. 4.
Figure 8:
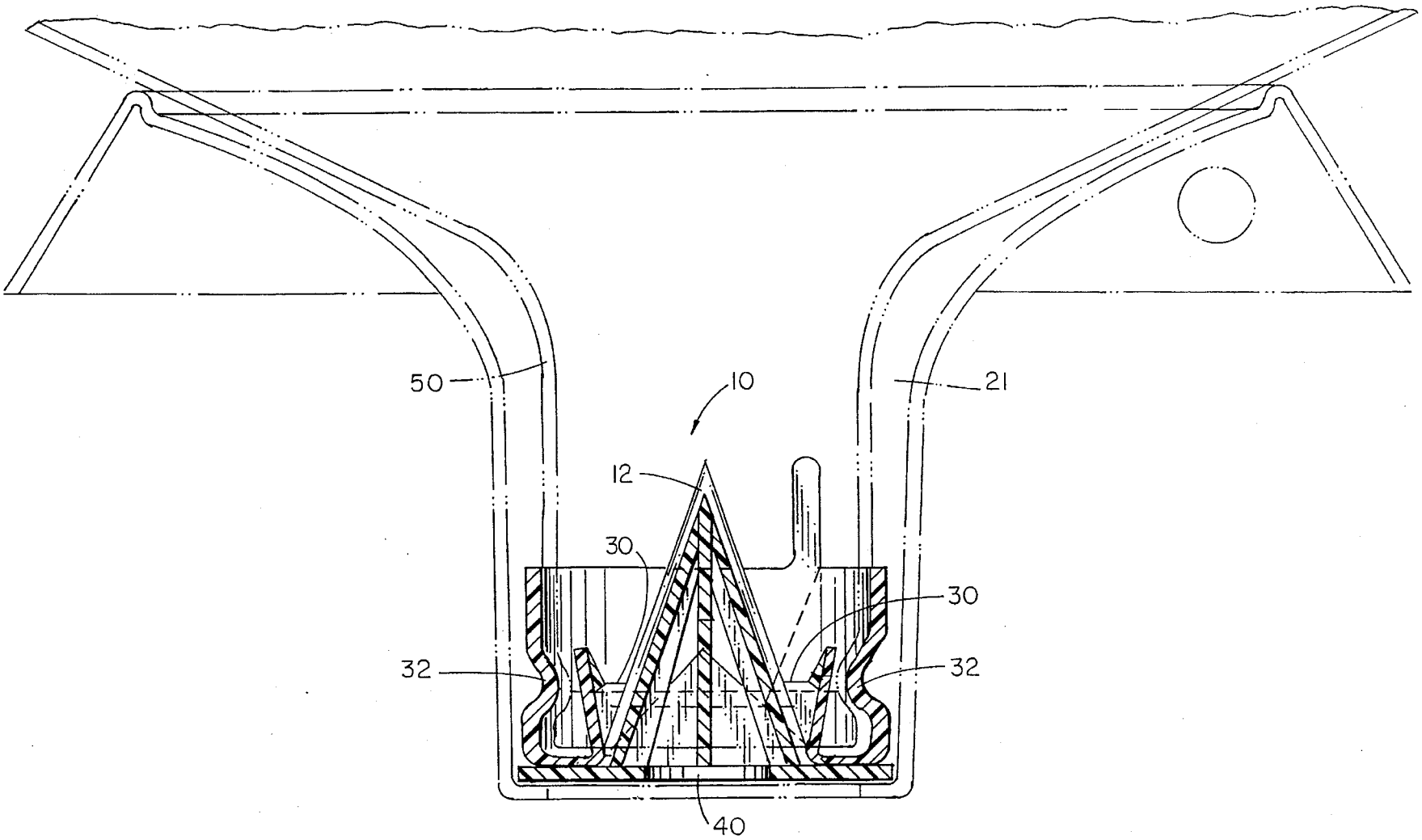
FIG. 8 of the drawing is a cross-sectional view of the piercer of the invention taken along the lines 8—8 of FIG. 1 with double-dotted phantom lines depicting a bottle support member and triple dotted phantom lines depicting a typical water bottle.

In the embodiment of FIG. 1 the back edges 22 of the blades 24 and a line or arc running along the base 20 from one blade 24 to the next define an inset pyramid having two open faces 26 and two closed faces 28. The numbers of open 26 and closed faces 28 may vary. Moreover, the faces may be inset to the back edges 22 of the blades 24, or may extend from the base portion 20 to the base of the cutting edges 12 (e.g., as shown in FIGS. 4 and 5). It will be understood that other geometrical choices (e.g., a closed face generally shaped like a spherical triangle) are possible. In all cases, a central throughhole 40 in the base 20 communicates with an open face 26 to provide a generally axial flow path for liquid flowing from the bottle 50. In a preferred embodiment having four blades 12, two open faces 26, and two closed faces 28, the two open faces are disposed in diametrically opposed positions.

Upstanding planar spreader members 30 are employed in the apparatus 10 to prevent cut portions of a seal 32 from obstructing the flow of water. The spreaders 30 may be configured as free-standing elements 34 extending upward from the base 20, as ridge-like portions 36 extending upward from the base 20 and outward from a closed face 28 equidistant between the two blade members 24 bounding that face 28, or as filleted 37 or unfilleted 38 blades extending outward from a knife blade 24 adjacent the intersection of that blade 24 and the base 20 and partially obstructing an open face 26.

The base 20 has a diameter chosen to fit the inlet port 21 of a dispensing vessel and comprises a large central throughhole 40 communicating with an open face 26 and serving as the principal passage for water flow into the dispensing vessel. An additional peripheral throughhole or throughholes 42 in the base 20, disposed outward of and adjacent the bottom edge of a closed face 28 where the face 28 intersects the base 20, provides another flow path (indicated by arrows 44) for the air displacing water from the bottle. The peripheral throughholes 42 are located close enough to the bottom of the associated closed face 28 and are at least partially unobstructed by any overlying portion of the cut seal 32. In one embodiment, the planar blade members 24 intersect the base 20 along a first circle and the cut seal 32 abuts the base 20 along a second concentric circle external to the first circle.

The piercer 10 may be made by an injection molding process, and is therefore generally configured to be easily released from a mold. One feature of some embodiments of the invention, an undercut 46 associated with a spreader 30, the functioning of which will be hereinafter described, may be fabricated by a post molding operation, such as pressing an appropriately shaped hot tool into the base of the spreader 30. It will be recognized that other approaches may be employed to make the piercer 10. These may include assembling separate sheets of material to form the blades 12, spreaders 30, closed faces 28, base 20 and other portions of the piercer 10.

Figure 7:
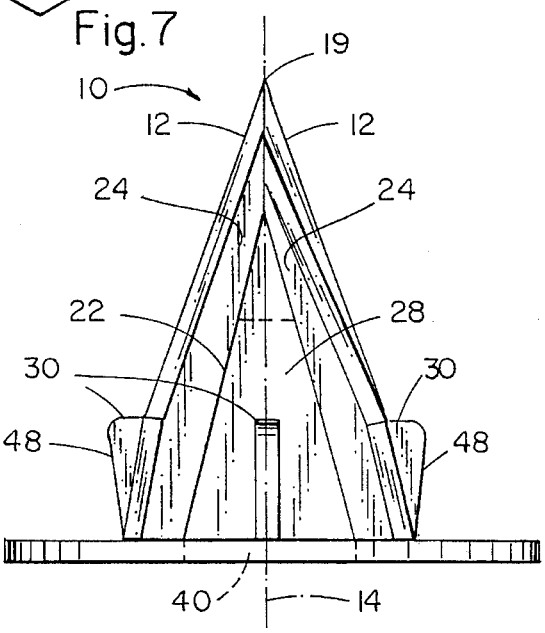
FIG. 7 of the drawing is an elevational view of the apparatus of FIG. 1 taken along the lines 7—7 of FIG. 1.
Figure 3:
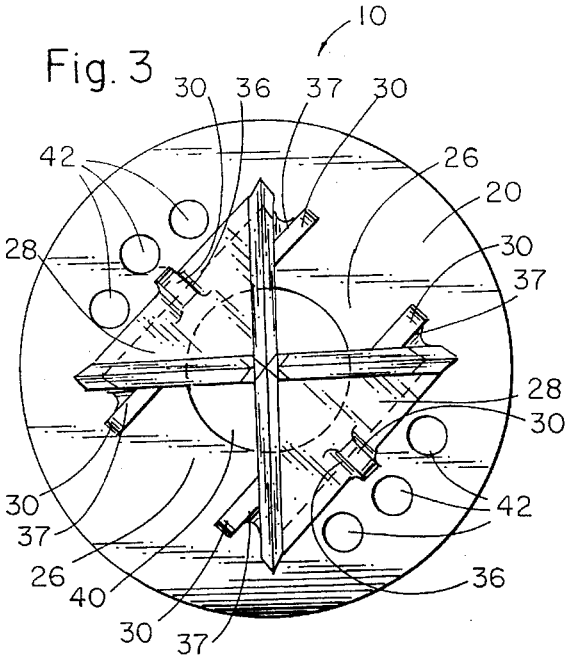
FIG. 3 of the drawing is a top planar view of apparatus similar to that of FIG. 1, but having filleted spreaders.

The piercer 10 is preferably used similarly to that taught by Deruntz in U.S. Pat. No. 4,846,236 by being placed in the inlet port 21 of a dispensing vessel. When an inverted water bottle 50 having a mouth closed by a flexible seal 32 is put onto the knife edges 12, the seal 32 (which is shown in the drawing as a single plastic layer in the interest of simplicity of presentation, but which usually comprises an outer layer of high density polyethylene and an inner layer of polyurethane foam) is slit into a plurality of flaps. Some flaps are forced downward toward closed faces 28 by the flow of water, but are held off those faces by appropriate spreaders 34. Providing an undercut region 46 in a spreader 30 allows the seal material to protrude below an overhanging portion of the spreader 30, which serves to clinch the bottle to the apparatus 10. Alternately, a spreader 30 may be made with a face 48 slanting away from the axis in an opposite sense to that of the knife edges 24 (e.g., as seen in FIG. 7). Other means of locally distorting the cut edge of seal 32 to clinch the bottle to the apparatus 10 may also be employed. Thus, even a nearly empty bottle stays on the apparatus 10, rather than "climbing" out of the dispenser inlet 21.

The combination of relatively open flow channels through the open pyramidal faces 26 and of relatively restricted flow channels along the closed pyramidal faces 28 is believed to partially separate water and air flows through the apparatus 10. Water preferentially flows through the more open channel, while the more fluid air flows along the closed faces as a column of relatively small bubbles. This flow separation serves to reduce the incidence of disturbing "burping" noises when a single large air bubble rises through the water. Tests show that a water bottle 50 opened with the piercer 10 drains more quietly than does one from which the seal is completely removed before its being inserted into the inlet port 21 of a dispenser.

Tests on the apparatus 10 of the invention show that it provides convenient hygienic operation and freedom from spills without significant loss of efficiency. A completely opened conventional water bottle inverted over a receiving vessel larger than the bottle drains in about forty seconds. A similar sealed bottle 50 placed on and pierced by a piercer 10 drains completely in about two minutes. A water bottle with the requisite special seal, when inverted over the prior art Ebco valved assembly, required more than five minutes to drain.

Although the present invention has been described with respect to several preferred embodiments, many modifications and alterations can be made without departing from the invention. Accordingly, it is intended that all such modifications and alterations be considered as being within the spirit and scope of the invention as defined in the attached claims.

What is desired to be secured by Letters Patent is:

1. Apparatus for cutting a star-shaped array of slits through a flexible seal closing the mouth of an inverted bottle, the apparatus comprising a base portion having a central throughhole, a pyramidal array of three or more blades extending upwards from the base portion, the blades cutting the slits when the inverted bottle is placed upon the apparatus, a closed pyramidal face extending upwards from the base portion intermediate a first adjacent pair of blades of the pyramidal array thereof, a peripheral throughhole in the base portion adjacent an intersection of the closed face and the base portion, an open pyramidal face extending intermediate a second adjacent pair of blades of the pyramidal array thereof, the open pyramidal face communicating with the central throughhole, a first spreader adjacent the peripheral throughhole and extending outward from the closed face, and a second spreader adjacent the base, the second spreader partially obstructing the open face, wherein each spreader holds a portion of the cut seal outward of the respective one of the faces.

2. The apparatus of claim 1 wherein the base portion is circular, and wherein the pyramidal array of blades comprises four blades, the apparatus further comprising a second open face having a third spreader associated therewith, and a second closed face having a fourth spreader associated therewith, wherein the first open face and the second open face are diametrically opposed to each other.

3. The apparatus of claim 1 wherein the blades define a bent pyramid.

4. The apparatus of claim 1 wherein the pyramidal array of blades comprises four blades, a first pair of the blades intersecting at a first apex, the remaining two blades intersecting at a second apex.

5. The apparatus of claim 1 wherein the first spreader associated with the closed face extends radially outward therefrom and is disposed equidistant between the two blades bounding the closed face.

6. The apparatus of claim 1 wherein the blades intersect the base portion along the circumference of a first circle, wherein a portion of the seal into which the star shaped array of slits is cut abuts the base member along the circumference of a second circle external to the first circle, and wherein a portion of the peripheral throughhole is intermediate the first and the second circles.

7. Apparatus for piercing a flexible seal closing a mouth of an inverted bottle, the apparatus comprising:

a base having a central throughhole therethrough;

a pyramidal array of three or more upstanding blades extending upwards from the base and slanting therefrom towards an axis of the apparatus, at least two of the blades having a cutting edge on an upper surface thereof, each cutting edge piercing the seal when the inverted bottle is placed upon the apparatus;

a closed pyramidal face extending upwards from the base intermediate a first adjacent pair of blades of the pyramidal array thereof;

an open pyramidal face extending upwards from the base intermediate a second adjacent pair of blades of the pyramidal array thereof, three spreaders adjacent the base, each of a first two of the spreaders respectively extending outwards from one of the second pair of blades and thereby partially obstructing the open face, the third spreader extending outward from the closed face.

* * * * *